US009282766B2

(12) United States Patent
Besso et al.

(10) Patent No.: US 9,282,766 B2
(45) Date of Patent: Mar. 15, 2016

(54) SMOKING ARTICLE INCLUDING FLAVOUR GRANULES

(75) Inventors: Clement Besso, Neuchatel (CH); Charles Kuersteiner, Jouxtens-Mezery (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 13/993,147

(22) PCT Filed: Dec. 12, 2011

(86) PCT No.: PCT/EP2011/072459

§ 371 (c)(1), (2), (4) Date: Jul. 18, 2013

(87) PCT Pub. No.: WO2012/080174

PCT Pub. Date: Jun. 21, 2012

(65) Prior Publication Data

US 2014/0299135 A1 Oct. 9, 2014

(30) Foreign Application Priority Data

Dec. 13, 2010 (EP) ..... 10252103

(51) Int. Cl.

| | |
|---|---|
| ***A24D 3/06*** | (2006.01) |
| ***A24D 3/14*** | (2006.01) |
| ***A24D 1/00*** | (2006.01) |
| ***A24D 3/04*** | (2006.01) |

(52) U.S. Cl.

CPC ..... *A24D 1/002* (2013.01); *A24D 3/048* (2013.01); *A24D 3/06* (2013.01); *A24D 3/14* (2013.01)

(58) Field of Classification Search

CPC ..... A24D 3/061; A24D 3/06; A24D 3/14; A24D 1/002; A24B 15/283

USPC ..... 131/276

See application file for complete search history.

(56) References Cited

U.S. PATENT DOCUMENTS

| | | | | |
|---|---|---|---|---|
| 4,038,992 | A | 8/1977 | Ogasa | |
| 4,281,671 | A | 8/1981 | Bynre | |
| 4,981,522 | A * | 1/1991 | Nichols | A24B 15/165 131/194 |

(Continued)

FOREIGN PATENT DOCUMENTS

| | | |
|---|---|---|
| CN | 101707899 A | 10/2012 |
| EA | 200701446 | 10/2007 |

(Continued)

OTHER PUBLICATIONS

PCT International Search Report and Written Opinion dated Apr. 27, 2012 for PCT/EP2011/072459.

(Continued)

*Primary Examiner* — Anthony Calandra

(74) *Attorney, Agent, or Firm* — Mueting, Raasch & Gebhardt, P.A.

(57) ABSTRACT

A smoking article (10, 20, 30) comprises a filter (4) having a flavor release segment (14, 24) including a plurality of flavor granules. The flavor granules are formed of a compacted herbaceous plant material and have a bulk density of at least 0.35 grams per cubic centimeters. The plant material preferably comprises herb leaf and most preferably peppermint leaf. The flavor granules may be distributed in a plug of fibrous filtration material or may be provided in a cavity within the filter (4).

16 Claims, 1 Drawing Sheet

(56) References Cited

U.S. PATENT DOCUMENTS

| | | | | |
|---|---|---|---|---|
| 7,074,170 | B2 | 7/2006 | Lanier, Jr. | |
| 7,784,470 | B2 | 8/2010 | Paine, III | |
| 7,799,282 | B2 | 9/2010 | Kahl | |
| 2005/0066981 | A1 | 3/2005 | Crooks | |
| 2007/0000505 | A1 | 1/2007 | Zhuang | |
| 2008/0029114 | A1 | 2/2008 | Seitert | |
| 2009/0044817 | A1* | 2/2009 | Besso et al. | 131/276 |
| 2009/0246525 | A1* | 10/2009 | Uchida et al. | 428/402 |
| 2010/0282267 | A1* | 11/2010 | Atchley ..... A23L | 1/22016 131/275 |
| 2011/0309559 | A1 | 12/2011 | Franke | |
| 2013/0160780 | A1 | 6/2013 | Matsumoto | |

FOREIGN PATENT DOCUMENTS

| | | | |
|---|---|---|---|
| EP | 2 042 635 | | 4/2009 |
| JP | 10182842 | | 7/1998 |
| JP | 2002-218964 | | 8/2002 |
| JP | 2005-287506 | | 10/2005 |
| JP | 2008-156791 | | 7/2008 |
| JP | 2010-051319 | | 3/2010 |
| JP | 2010-187171 | | 8/2010 |
| JP | 2010-528652 | | 8/2010 |
| JP | 2010-536336 | | 12/2010 |
| WO | WO 03/059096 | | 7/2003 |
| WO | WO 2008/064463 | | 6/2008 |
| WO | 2008/150130 | | 12/2008 |
| WO | WO 2008/150130 | | 12/2008 |
| WO | WO 2008/150130 | A1 | 12/2008 |
| WO | WO 2009/022232 | | 2/2009 |
| WO | WO 2009/024866 | | 2/2009 |
| WO | 2009/080368 | | 7/2009 |
| WO | WO 2009093051 | A2 * | 7/2009 |
| WO | WO 2010/069686 | A2 | 6/2010 |

OTHER PUBLICATIONS

Office Action issued in China for Application No. 201180059451.7 dated Jun. 30, 2014. English translation included. (20 pages).

Office Action issued I Kazakhstan for Application No. 2013/1588.1 Aug. 26, 2014. English translation included. (8 pages).

Office Action issued in Japan for Application No. 2013-543686 dated Sep. 28, 2015 (20 pages). English translation included.

Office Action issued in Russia for Application No. 2013132206 dated Nov. 17, 2015 (6 pages). English translation included.

* cited by examiner

SMOKING ARTICLE INCLUDING FLAVOUR GRANULES

This application is a U.S. National Stage Application of International Application No. PCT/EP2011/072459, filed Dec. 12, 2011, which was published in English on Jun. 21, 2012 as International Patent Publication WO 2012/080174 Al. International Application No. PCT/EP2011/072459 also claims priority to European Application No. 10252103.6, filed Dec. 13, 2010.

The present invention relates to a smoking article including a plurality of flavour granules formed of compacted plant material.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which tobacco is heated rather than combusted have also been proposed in the art. In heated smoking articles, an aerosol is generated by heating a flavour generating substrate, such as tobacco. Known heated smoking articles include, for example, electrically heated smoking articles and smoking articles, in which an aerosol is generated by the transfer of heat from a combustible fuel element or heat source to a physically separate aerosol forming material. During smoking, volatile compounds are released from the aerosol forming substrate by heat transfer from the fuel element and entrained in air drawn through the smoking article. As the released compounds cool they condense to form an aerosol that is inhaled by the consumer.

To enhance the flavour of the mainstream smoke, it is known to provide smoking articles with flavourants, for example, in the filter. In particular, it has been proposed to include flavourants in the form of plant material, such as leaves, seeds or roots, from one or more aromatic plants.

It would be desirable to provide means for releasing flavour for a smoking article that, in use, provides improved flavour enhancement, and in particular improved mint and menthol flavour delivery, to a consumer. Furthermore, it would be desirable to provide means for releasing flavour for a smoking article that minimises loss of flavour prior to smoking, for example during storage of the smoking article.

According to the present invention there is provided a smoking article comprising a flavour release segment including a plurality of flavour granules formed of a compacted herbaceous plant material capable of releasing flavour into the smoke produced by the smoking article. The bulk density of the flavour granules is at least 0.35 grams per cubic centimetre ($g/cm^3$).

Smoking articles according to the present invention preferably comprise an aerosol generating substrate and a mouthpiece in axial alignment with the aerosol generating substrate. In certain preferred embodiments of the present invention, the aerosol generating substrate of the smoking article comprises a rod of smokable material, such as tobacco, and the mouthpiece comprises a filter including one or more filter segments. The rod of smokable material is preferably attached to the filter by tipping paper.

The flavour granules may be incorporated into any suitable portion or component of a smoking article. For example, the flavour granules may be incorporated into a rod of smokable material or filter of a combustible smoking article, such as a filter cigarette, or may be incorporated into an aerosol-generating substrate or filter of a heated smoking article. It will be appreciated that flavour granules may be incorporated into more than one portion or component of a smoking article according to the present invention.

The flavour granules of the present invention are discrete, solid particles formed of a compacted herbaceous plant material. By compacted, it is meant that the plant material has been subjected to a mechanical process to densify the plant material. In some instances the compaction disrupts the cellular structure of the plant material and causes at least a partial release of the essential oils in the plant material. As described further below, in one example the plant material may be extruded. Water may be incorporated into the granules as a processing aid for the compaction process. Preferably, the flavour granules are free of non-aqueous binder materials.

As used herein, the term "herbaceous plant material" is used to denote a material consisting of one or more parts of an herbaceous plant. The term "herb leaf" is used to denote leaf from an herbaceous plant.

An "herbaceous plant" is an aromatic plant, the leaves or other parts of which are used for medicinal, culinary or aromatic purposes and are capable of releasing flavour into smoke produced by a smoking article. The flavour granules used in the present invention may comprise herbaceous material from one or more perennial or annual herbaceous plants. For example, the flavour granules may comprise herb leaf or other herbaceous material from herbaceous plants including, but not limited to, mints, such as peppermint and spearmint, lemon balm, basil, cinnamon, lemon basil, chive, coriander, lavender, sage, tea, thyme and carvi. Preferably, the flavour granules comprise non-tobacco plant material.

The herbaceous plant material in the flavour granules within the smoking article releases flavour during smoking, thereby altering the flavour characteristics of the smoke. Advantageously, the plant material of the flavour granules can be varied in order to tailor the flavour profile of the smoking article into which the flavour granules are incorporated. The inclusion of granules of plant material also improves retention of flavours within the smoking article compared to conventionally used liquid flavourants.

The flavour granules may comprise particles formed from any suitable part of an herbaceous plant, including but not limited to the leaves, stem, root, flower and fruit. The flavour granules may include plant material from one or more plants.

In preferred embodiments of the present invention, the flavour released from the herbaceous plant material is provided by volatile compounds, such as oils, contained therein. Prior to smoking, the volatile compounds tend to remain trapped within the plant material, but are volatilised during smoking, thereby enriching the smoke with flavour. The flavour characteristics of the smoke can be altered depending on the plant material selected for inclusion in the flavour granules.

The herbaceous plant material is cut, ground or otherwise reduced in size to provide a particulate material. The particulate plant material is then compacted to increase the density in order to form the flavour granules having a bulk density of at least 0.35 grams per cubic centimetre.

In some cases, the bulk density of the original herbaceous plant material prior to compaction is around 0.20 to 0.30 grams per cubic centimetre. The compaction of the plant material to form the flavour granules preferably increases the bulk density so that the bulk density of the flavour granules is preferably at least 1.5 times, more preferably at least twice, the bulk density of the original plant material. In some cases, the plant material is compacted to yield a bulk density of more than three times that of the original plant material. For example, the bulk density of the flavour granules is preferably at least 0.40 grams per cubic centimetre and even more preferably at least 0.50 grams per cubic centimetre. Preferably, the plant material is compacted to yield a bulk density of less than 6 times the bulk density of the original plant material. For example, the bulk density of the flavour granules is preferably no more than 2.0 grams per cubic centimetre.

The term "bulk density" is used to refer to the density of the combined plurality of the flavour granules, which corresponds to the mass of the plurality of flavour granules divided by the volume occupied by those flavour granules. In the context of the present invention, the values of bulk density referred to correspond to the Carr Loose Bulk Density of the granules. A suitable method for determining the Carr Loose Bulk Density of the flavour granules is described in ASTM standard D 6393-08. In this method, a measurement is obtained by sieving the sample of flavour granules through a vibrating chute to fill a measuring cup of a known volume. The mass of flavour granules within the cup is then measured and this is divided by the volume of the cup to arrive at the bulk density.

The compaction of the herbaceous plant material concentrates the flavourants within the plant material and increases the amount of flavourants that can be provided per unit volume of the smoking article. By increasing the bulk density of the plant material, it becomes possible to incorporate a greater mass of plant material into the smoking article within the same volume of the smoking article. The flavour delivery into the mainstream smoke during smoking can thereby be improved and intensified. The compaction of the plant material may alternatively allow the same mass of plant material to be more efficiently incorporated within a smaller volume of the smoking article than the corresponding mass of the original plant material, so that the volume available for other components is increased.

As the herbaceous plant material is compressed in order to increase the density during the formation of the flavour granules, the plant material may be crushed to some extent so that the cellular structure is at least partially broken down or destroyed. In some cases, this results in the release of the essential oils in the plant material from within the cellular structure, such that a greater proportion of the essential oils are available for release into the mainstream smoke during smoking.

In preferred embodiments of the present invention, the flavour granules comprise compacted particles of a menthol-containing herbaceous plant leaf, such as peppermint leaf. In particularly preferred embodiments of the present invention, the flavour granules comprise compacted particles of mint leaf from plants of the genus *Mentha*. For example, suitable types of mint leaf may be taken from plant varieties including but not limited to *Mentha piperita, Mentha arvensis, Mentha niliaca, Mentha citrata, Mentha spicata, Mentha spicata crispa, Mentha cordifolia, Mentha longifolia, Mentha pulegium, Mentha suaveolens*, and *Mentha suaveolens variegata*.

Preferably, the oil content of the mint leaf is at least about 0.6% by weight. The inclusion of particles of mint leaf, such as peppermint leaf, in flavour granules used in smoking articles according to the present invention advantageously provides an improved way of imparting mint and menthol flavours to the smoke of a smoking article.

The term "mint flavour" is used to refer to the flavour or the flavour extract present in mint plants, such as a peppermint plant and spearmint. The term "menthol" is used to refer to a specific flavour component present in peppermint oil and other mint oils.

It has been found that the compaction of the mint leaf to form the flavour granules increases the proportion of the menthol content of the mint leaf that is transferred into the smoke during smoking of a smoking article incorporating the flavour granules. Therefore, not only is it possible to maximise the mass of plant material incorporated into a given volume of the smoking article through compaction of the plant material, but the compaction also improves the delivery of the menthol into the smoke. Smoking articles according to the invention are therefore able to provide a significantly improved level of flavour delivery into the mainstream smoke.

The improved flavour delivery of the flavour granules used in the present invention may be demonstrated by calculating the amount of a component of the herbaceous plant material that is released from the flavour granules into the smoke per unit of bulk volume of the plant material (referred to herein as the delivery per cubic centimetre of bulk volume) when the flavour granules are provided in the filter of a filter cigarette. A suitable test may be set up to measure the total amount in micrograms of the component of the plant material that is released into the mainstream smoke of the filter cigarette when the cigarette is smoked under ISO conditions. For example, during smoking, the particulate phase of the mainstream smoke may be collected in a suitable trap or filter and the collected smoke sample is then extracted in a suitable solvent and analysed using gas chromatography to identify the levels of different components within the smoke.

One example of such a method for quantifying the amount of menthol released during smoking is the Menthol In Smoke (MIS) test. The skilled person would appreciate that similar tests could alternatively be used to quantify the amount of other components of the plant material that are released into the smoke.

Once the total amount of the flavour component released into the smoke has been measured, the "bulk volume" (in cubic centimetres) of the flavour granules in the filter cigarette is then calculated by dividing the weight of the plant material (grams) by the bulk density (grams per cubic centimetre). The delivery of the flavour component per unit bulk volume is then calculated by dividing the total amount of the component delivered into the smoke (in micrograms) by the bulk volume (cubic centimetres).

It has been found that the value of the delivery of certain flavour components of the herbaceous plant material per cubic centimetre of bulk volume is higher for the granules produced from compacted plant material than from the original plant material. In fact, it has surprisingly been found that in cases in which the bulk volume of the plant material is increased by about 100% with the compaction or densification step, the delivery per cubic centimetre of bulk volume increases by more than 100%.

Preferably, in a smoking article according the present invention wherein the flavour granules comprise compacted mint leaf, the delivery of menthol per bulk volume is at least 0.05 micrograms per cubic centimetre, preferably at least 0.06 micrograms per cubic centimetre, and more preferably at least 0.07 micrograms per cubic centimetre. The amount of menthol delivered in the smoke may be at least 130 micrograms of menthol per mg of plant material, preferably at least 135 micrograms of menthol per mg of plant material, and more preferably at least 140 micrograms of menthol per mg of plant material. This is increased compared to the amount of menthol released per mg of the original, uncompacted mint leaf.

Preferably, the herbaceous plant material in the flavour granules is cut before compaction in order to provide a particulate material of the plant material having an average particle size of between 0.2 mm and 5 mm. More preferably, the average particle size of the particles of plant material is between 1 mm and 2 mm. The cutting of the plant material to particles within this size range has been found to advantageously improve the adhesion of the particles to each other in the flavour granules.

The compaction of the herbaceous plant material to form the flavour granules may be carried out by any suitable method. Preferably, the flavour granules are formed by an extrusion method, in which the plant material is simultaneously compacted and shaped into granules by being forced through an extrusion die under pressure. Suitable extrusion apparatus including, for example, screw extruders, would be well known to the skilled person. Suitable techniques for forming the granules after compaction of the plant material has been carried out include but are not limited to high shear granulation and spheronisation.

Details of suitable extrusion and spheronisation techniques can be found, for example, in "Extrusion—Spheronisation—A Literature Review" by Chris Vervaet et al, 1995 International Journal of Pharmaceutics 116:131-146.

Preferably, the moisture content of the particles of herbaceous plant material is increased to approximately 35% to 45% oven volatiles prior to compaction of the plant material to form the granules. Preferably, the moisture content of the plant material is maintained within these limits during the compaction process. In order to achieve this, for example during an extrusion process, it may be necessary to cool the plant material and/or the compaction apparatus as the plant material is being compacted.

The moisture content of the herbaceous plant material is expressed herein as "% oven volatiles", which is determined by measuring the percentage weight loss from the plant material upon drying the material in an oven at 103° C. for 100 minutes. It is assumed that a significant majority of the weight loss from the flavour material results from the evaporation of moisture from the plant material.

Once formed, the flavour granules will typically need to undergo a drying step in order to at least partially remove the water present therein. Preferably, the formed flavour granules are dried at room temperature to a moisture content of at least 6% oven volatiles (o.v.) more preferably at least 8% o.v. Preferably, the moisture content of the formed flavour granules after drying is less than 15% o.v., more preferably less than 12% o.v. and most preferably less than 10% o.v. For example, the moisture content of the flavour granules after drying is preferably between about 6% and about 15% o.v., more preferably between about 8% and about 12% o.v. and most preferably between about 8% and about 10% o.v.

The flavour granules may be formed into any suitable shape, but are preferably substantially cylindrical or spherical. On average, the largest cross sectional dimension of the flavour granules is preferably at least 0.1 mm, more preferably at least 0.2 mm. Preferably, the largest cross sectional dimension of the flavour granules is less than 2.5 mm, more preferably less than 1.5 mm. For example, the largest cross sectional dimension is preferably between about 0.1 mm and about 2.5 mm, more preferably between about 0.2 mm and about 1.5 mm. Preferably, the particle size distribution of the flavour granules is minimised.

If desired, additional reagents may be incorporated into the mixture for forming the flavour granules in order to aid the extrusion, spheronisation or granulation process, for example, by preventing or minimising separation of the liquid from the solid or by improving flow properties of the mixture. Suitable extrusion, spheronisation and granulation aiding reagents are well known to the skilled person. However, preferably, as described above, the only additional reagent incorporated into the flavour granules is water.

If it is desired to further increase the flavour loading of the flavour granules, a liquid flavourant, such as a liquid menthol flavourant may be incorporated into or onto the flavour granules after drying. Alternatively or in addition, a liquid flavourant, such as a liquid menthol flavourant, may be added to filtration material in a filter incorporating the flavour granules.

Optionally, the flavour granules may further comprise a coating. A preferred coating may be formed from low molecular weight chitosan solution (0.5 to 1.0%). It has been found that the provision of a coating on the outer surface of the flavour granules advantageously results in a significant reduction in migration and volatilisation of volatile flavours from the liquid flavourant and particles of plant material in the flavour granules prior to smoking. The provision of a coating further enhances the effect of trapping the liquid flavourant within the pores of the porous support material such that the undesired premature release of flavour from the flavour granules can be minimised.

Where a coating is provided on the flavour granules, this may be applied to the dried granules obtained from the extrusion, spheronisation or granulation process using any suitable apparatus, such as for example a fluidised bed sprayer. Suitable fluidised bed sprayers are available from Glatt GmbH, Germany.

Smoking articles according to the present invention comprising a plurality of flavour granules may comprise any number of flavour granules that is suitable to provide flavour enhancement to the smoke thereof during smoking. For example, smoking articles according to the invention may comprise between about 2 and about 25,000 flavour granules, for example between about 2 and 15,000 flavour granules.

The flavour granules may advantageously be incorporated into a wide variety of different types of smoking articles. For example, the flavour granules may be incorporated into combustible smoking articles, such as filter cigarettes, in which the aerosol generating substrate is a rod of tobacco cut filler or other smokable material, which is combusted during smoking. Alternatively, the flavour granules may be incorporated into heated smoking articles of the type described above in which the aerosol generating substrate is heated to form an aerosol, rather than combusted. For example, flavour granules according to the present invention may be incorporated into a heated smoking article comprising a combustible heat source, such as that disclosed in WO-A-2009/022232, which comprises a combustible heat source and an aerosol-generating substrate downstream of the combustible heat source. The flavour granules may also be incorporated into heated smoking articles comprising non-combustible heat sources, for example, chemical heat sources or electrical heat sources such as electrical resistive heating elements.

As used herein, the term "smoke" is used to describe smoke produced by combustible smoking articles, such as filter cigarettes, and aerosols produced by non-combustible smoking articles, such as heated smoking articles of the types described above.

In preferred embodiments of the present invention, the smoking article comprises a filter having a flavour release segment including a plurality of the flavour granules. Alternatively or in addition, the smoking article may comprise a rod of smokable material within which a plurality of the flavour granules is dispersed.

In a first aspect of the present invention, a plurality of the flavour granules is provided within a flavour release segment of a filter, wherein the flavour granules are distributed in a plug of fibrous filtration material, such as cellulose acetate tow or paper. Preferably, the flavour granules are substantially evenly distributed along the length of the plug of fibrous filtration material.

The fibres in the fibrous filtration material may be substantially aligned in the longitudinal direction of the filter and extend along substantially the entire length of the plug of fibrous filtration material. Alternatively, the fibres in the fibrous filtration material may be randomly oriented and extend part way along the length of the plug of fibrous filtration material. Optionally, a filter plasticiser may be applied to the fibrous filtration material in a conventional manner, by spraying it onto the separated fibres. Preferably, the filter plasticiser is applied to the fibrous filtration material before the flavour granules are distributed therein.

In smoking articles according to the first aspect of the invention, the flavour segment is preferably between about 5 mm and about 22 mm in length, more preferably between about and 10 mm about 15 mm in length, most preferably about 12 mm in length.

Preferably, smoking articles according to the first aspect of the present invention further comprise a mouth end segment or a mouth end cavity downstream of the flavour release segment, as described in more detail below.

In a second aspect of the present invention, a plurality of the flavour granules is provided within a flavour release segment of a filter, wherein the flavour release segment comprises a cavity at least partially filled with the flavour granules. The cavity is provided between an upstream segment, for example any of the rod end segments described below, and a downstream segment, for example any of the mouth end segments described below. Preferably, at least 40% of the cavity is filled with flavour granules, more preferably at least 60%. Preferably, up to 80% of the cavity is filled with flavour granules, more preferably up to 100%. The cavity filters of smoking articles according to the second aspect of the invention may be produced using known machinery for producing charcoal filters, such as that described in EP-A-1,571,933. Such machinery is available from Filtrona International Ltd., Great Britain.

Preferably, the cavity contains on average at least 0.5 mg of plant material per cubic millimeter of the cavity.

Throughout the specification, the terms "upstream" and "downstream" are used to describe the relative positions of segments or components of smoking articles according to the present invention in relation to the direction of the smoke drawn through the smoking articles during use. For example, in a filter where the flavour release segment is upstream of a mouth end segment, the smoke is drawn first through the flavour release segment and then through the mouth end segment.

In smoking articles according to the second aspect of the invention, the flavour release segment is preferably between about 2 mm and about 12 mm in length, more preferably between 3 mm and 8 mm and most preferably between 4 mm to 7 mm.

The loading of flavour granules in the flavour release segment of filters of smoking articles according to the invention is preferably at least 2 mg/mm for a filter having a diameter of between about 7.5 mm and about 7.85 mm, more preferably at least 5 mg/mm and most preferably at least 8 mg/mm. The loading of flavour granules in the flavour release segment is preferably up to 16 mg/mm for a filter having a diameter of between about 7.5 mm and about 7.85 mm, more preferably up to 20 mg/mm or in certain cases up to 30 mg/mm.

The normalised loading (mg per mm) will typically be higher where the flavour granules are provided in a cavity in accordance with the second aspect of the present invention than when the flavour granules are distributed through a plug of fibrous filtration material in accordance with the first aspect of the present invention. In smoking articles according to the first aspect of the present invention, the loading of flavour granules within the flavour release segment is preferably between 2 mg/mm and 20 mg/mm. In filters of smoking articles according to the second aspect of the present invention, the loading of flavour granules within the cavity is preferably between 20 mg/mm and 30 mg/mm.

Preferably, the total loading of flavour granules within the flavour release segment is at least 20 mg, more preferably at least 50 mg and most preferably at least 75 mg. Preferably, the total loading of the flavour granules is up to 150 mg, more preferably up to 180 mg and most preferably up to 200 mg.

Smoking articles according to the present invention comprising a flavour release segment including a plurality of flavour granules may be single segment filters, consisting of the flavour release segment only. Alternatively, smoking articles according to the invention may comprise multi-component filters comprising two or segments. For example, smoking articles according to the present invention may comprise multi-component filters further comprising at least one of: a rod end segment upstream of the flavour release segment and a mouth end segment downstream of the flavour release segment, as described above in relation to the second aspect of the invention. One or more additional flavour release segments comprising a plurality of flavour granules formed of the same plant material or a different plant material to that of the flavour granules in the first flavour release segment may optionally be provided.

Preferably, the mouth end segment (where present) comprises filtration material. More preferably, the mouth end segment comprises filtration material that has substantially no particulate phase filtration efficiency or very low particulate phase filtration efficiency. The mouth end segment may, for example, comprise cellulosic material, such as cellulose acetate tow, or other suitable fibrous filtration material of low filtration efficiency. Where the mouth end segment is formed of fibrous filtration material, the fibres therein may extend along substantially the entire length of the mouth end segment and be substantially aligned in the longitudinal direction of the filter. Alternatively, the fibres may extend part way along the length of the plug and be randomly oriented relative to the longitudinal axis of the filter.

The mouth end segment of multi-component filters in smoking articles according to the present invention may, in some embodiments, advantageously prevent flavour granules in the flavour release segment, or portions thereof, from reaching the mouth of a smoker during smoking.

Where the mouth end segment comprises filtration material, the length of the mouth end segment is preferably between about 3 mm and about 12 mm, more preferably between about 6 mm and about 8 mm.

Smoking articles according to the present invention may comprise a mouth end cavity downstream of the flavour release segment. For example, in certain embodiments, multi-component filters of smoking articles according to the present invention may further comprise a mouth end cavity downstream of the mouth end segment described above. The mouth end cavity may be formed by, for example, tipping paper circumscribing the filter. The length of the mouth end cavity is preferably 6 mm or less.

The rod end segment (where present) preferably comprises fibrous filtration material. The rod end segment may, for example, comprise cellulosic material, such as cellulose acetate tow, or other suitable fibrous filtration materials such as paper. Where the rod end segment is formed of fibrous filtration material, the fibres therein may extend along substantially the entire length of the rod end segment and be substantially aligned in the longitudinal direction of the filter. Alternatively, the fibres may extend part way along the length of the plug and be randomly oriented relative to the longitudinal axis of the filter.

The rod end segment may comprise at least one sorbent capable of removing at least one gas phase constituent from mainstream smoke drawn through the filter. Preferably, the at least one sorbent is selected from the group consisting of activated carbon, activated alumina, zeolites, sepiolites, molecular sieves and silica gel.

At least one of the mouth end segment and the rod end segment may include one or more flavourants, preferably one or more liquid flavourants, to further enhance flavour delivery to the smoker during smoking. Where the mouth end segment and the rod end segment both comprise at least one flavourant, the at least one flavourant in the mouth end segment may be the same as or different to the at least one flavourant in the rod end segment. Furthermore, the liquid flavourants in the mouth end segment and the rod end segment may provide the same or different flavour to that of the flavour granules in the flavour release segment of the filter.

Suitable flavours to be provided by liquid flavourants in the mouth end and rod end segments of multi-component filters of smoking articles according to the present invention include, but are not limited to, peppermint, spearmint, coffee, tea, spices (such as cinnamon, clove and ginger), cocoa, vanilla, fruit flavours, chocolate, eucalyptus, geranium, linalool and natural or synthetic menthol.

For example, at least one of the mouth end segment and the rod end segment may comprise a plug of filtration material including one or more threads impregnated with liquid flavourant. Filter plugs comprising flavourant bearing threads suitable for use in multi-component filters of smoking articles according to the present invention, and methods and apparatuses for producing such plugs, are described in U.S. Pat. Nos. 4,281,671 and 7,074,170 and are available from the American Filtrona Company, Richmond, Va., USA.

Alternatively or in addition, at least one of the mouth end segment and the rod end segment may include a plurality of beads impregnated with liquid flavourant. The beads may be formed from, for example, a cellulosic material bonded with a polyvinyl acetate binder, or from tobacco powder bonded with microcrystalline cellulose. Beads suitable for use in multi-component filters of smoking articles according to the present invention are manufactured and sold under the brand Viscopearls® by Rengo Co. Ltd., Japan. Methods and apparatuses for producing such beads are also described in Japanese Patent Application No. 10182842.

In preferred embodiments of the present invention in which the flavour granules comprise compacted particles of mint leaf, such as peppermint leaf, at least one of the mouth end segment and the rod end segment preferably comprises a liquid natural or synthetic menthol flavourant. This further enhances the flavour released into smoke drawn through the filter during smoking and complements the menthol and mint flavours released into the smoke by the flavour granules located in the flavour release segment.

Multi-component filters of smoking articles according to the present invention may further comprise a second flavour release segment to provide further flavour enhancement to the smoker during smoking. The second flavour release segment may include a plurality of flavour granules such as those described above for use in the first flavour release segment. Alternatively or in addition, the second flavour release segment may include tobacco leaf or non-tobacco plant leaf, or one or more liquid flavourants in any of the forms described above in relation to the mouth end segment and the rod end segment. The second flavour release segment may be provided upstream or downstream of the first flavour release segment.

Multi-component filters of smoking articles according to the present invention may be produced by forming separate continuous rods of filter material corresponding to each individual segment of the multi-component filter. The continuous rods are then cut to form individual sections of filter material and these sections are then combined in a known manner to form a continuous filter rod comprising repeating units of the multi-component filter. The continuous filter rod may then be subsequently severed at regular intervals by a cutting mechanism to yield a succession of discrete multi-component filters.

In certain embodiments, the wrapper used to wrap the tobacco rod may be coated with a solution of encapsulated flavours in beta-cyclodextrin, which odorises the mainstream smoke during smoking. A suitable example of such a coating is Emanate® (available from V. Mane Fils, France) which is a product consisting of a range of beta-cyclodextrin inclusion complexes such as Eugenol.

Smoking articles according to the present invention have a total nicotine free dry particulate matter (NFDPM) or "tar" delivery of up to about 10 mg, preferably up to about 6 mg, and more preferably up to about 1 mg. The "tar" delivery may be as low as 1 mg, more preferably as low as 0.1 mg. Preferably, the "tar" delivery is between 0.1 mg and 10 mg, more preferably between 1 mg and 10 mg or 0.1 mg and 6 mg and most preferably between 1 mg and 6 mg.

Preferably, the overall length of smoking articles according to the present invention is between about 70 mm and about 128 mm, more preferably about 84 mm.

Preferably, the external diameter of smoking articles according to the present invention is between about 5 mm and 8.5 mm, more preferably about 7.9 mm.

Preferably, where smoking articles according to the invention comprise filters, the overall length of the filters is between about 18 mm and about 36 mm, more preferably about 27 mm.

Where smoking articles according to the invention comprise multi-component filters, the length of each individual segment of the filters is preferably between about 5 mm and about 22 mm.

Smoking articles according to the present invention may be packaged in containers, for example in soft packs or hinge-lid packs, with an inner liner coated with one or more flavourants.

The invention will be further described, by way of example only, with reference to the accompanying drawings, in which.

The filter cigarettes shown in FIGS. 1 to 3 have several components in common and these components have been given the same reference numerals. In each of the side views, portions have been broken away to illustrate interior details of the filter.

Figure 1:
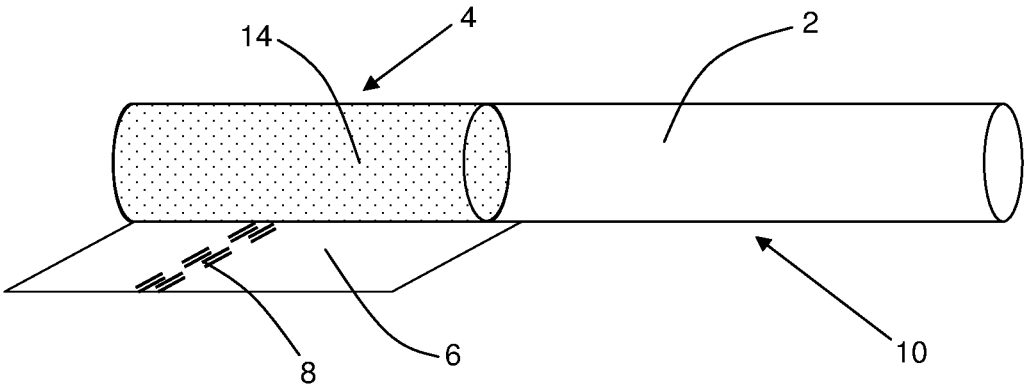
FIG. 1 shows a side view of a filter cigarette according to a first embodiment of the first aspect of the present invention, comprising a single segment filter.

Each filter cigarette generally comprises an elongate, cylindrical wrapped tobacco rod 2 attached at one end to an axially aligned, elongate, cylindrical, filter 4. The wrapped tobacco rod 2 and the filter 4 are joined in a conventional manner by tipping paper 6, which circumscribes the entire length of the filter and an adjacent portion of the wrapped tobacco rod 2. To mix ambient air with mainstream smoke produced during combustion of the wrapped tobacco rod 4, a plurality of annular perforations 8 are provided through the tipping paper 6 at a location along the filter 4.

Each filter 4 includes a flavour release segment 14 comprising a plurality of flavour granules having a total weight of approximately 25 mg. The flavour granules are cylindrical and have an average largest dimension of about 0.8 mm.

The flavour granules are formed from mint leaf, which has first been cut to a particle size of between 0.2 mm and 0.5 mm before being sprayed with steam to increase the moisture content of the mint leaf to between 35% and 45% oven volatiles. The wet mass of cut mint leaf is then extruded through a screw extruder to compact the mint leaf in order to increase the density, as well as shaping the mint leaf into the desired cross-sectional shape for the granules. The result extruded mass of mint leaf granules is then cut to form the granules having a size of around 0.8 mm and the granules are allowed to dry at room temperature.

The filter 4 of the filter cigarette 10 according to the first embodiment of the invention shown in FIG. 1 is a single segment filter consisting of a flavour release segment 14 adjacent to and abutting the wrapped tobacco rod 2. The flavour release segment 14 comprises a plug of cellulose acetate tow with a plurality of flavour granules substantially evenly distributed therein.

Figure 2:
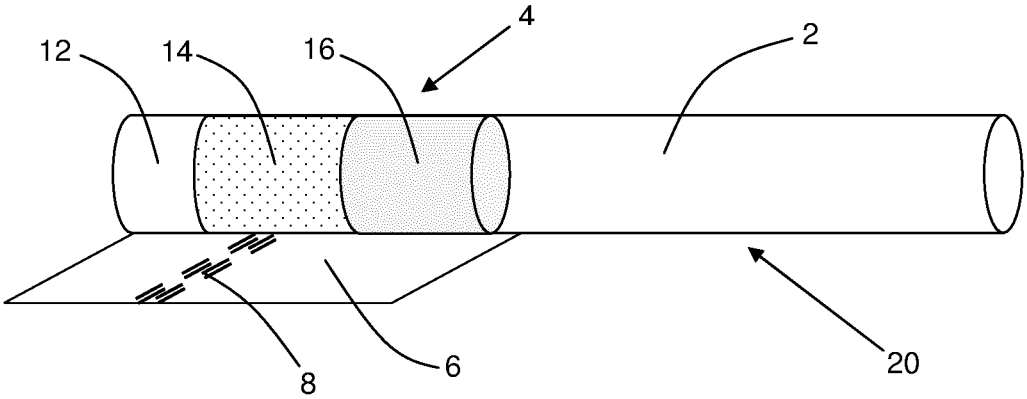
FIG. 2 shows a side view of a filter cigarette according to a second embodiment of the first aspect of the present invention, comprising a multi-component filter.

The filter cigarette 20 shown in FIG. 2 has a multi-component filter 4 that includes three segments in abutting end-to-end relationship: a mouth end segment 12, distant from the tobacco rod 2; a flavour release segment 14 located upstream of the mouth end segment; and a rod end segment 16, located upstream of the flavour release segment 14 and adjacent to and abutting the wrapped tobacco rod 2.

The mouth end segment 12 comprises a plug of cellulose acetate tow of low filtration efficiency plasticised with glycerol triacetate. The flavour release segment 14 is of the same construction as that previously described above for the filter cigarette 10 shown in FIG. 1.

The rod end segment 16 comprises a plug of cellulose acetate tow of medium to high filtration efficiency that, in use, partially filters out particulate phase components of the mainstream smoke.

Figure 3:
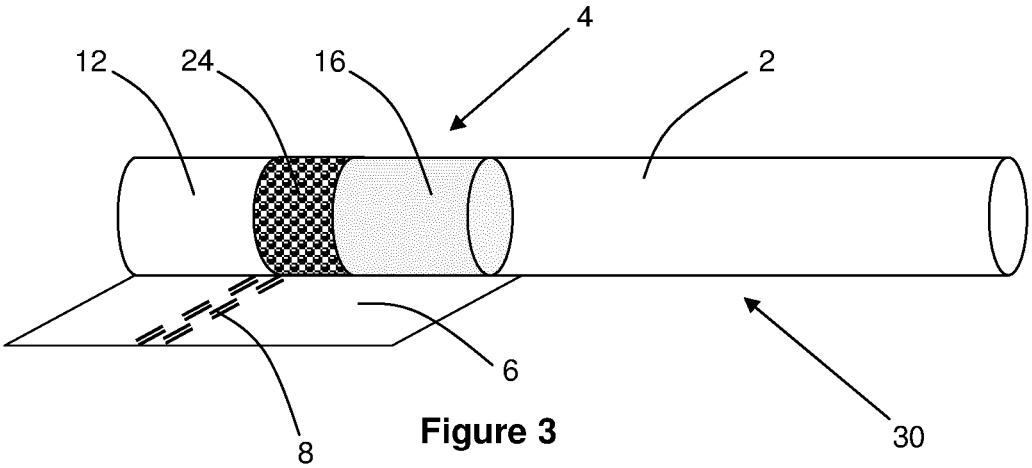
FIG. 3 shows a side view of a filter cigarette according to an embodiment of the second aspect of the present invention, comprising a multi-component filter.

The filter cigarette 30 shown in FIG. 3 has a multi-component filter 4 similar in construction to the multi-component filter 4 of the filter cigarette 20 shown in FIG. 2, with three segments in abutting end-to-end relationship: a mouth end segment 12, distant from the tobacco rod 2; a flavour release segment 24 located upstream of the mouth end segment 12; and a rod end segment 16, located upstream of the flavour release segment 24 and adjacent to and abutting the wrapped tobacco rod 2. The mouth end segment 12 and the rod end segment 16 are of the same construction as those previously described for the filter cigarette 20 shown in FIG. 2. The flavour release segment 24 comprises a cavity containing a plurality of flavour granules.

To form the filter cigarettes 10, 20, 30 according to the embodiments of the present invention shown in FIGS. 1 to 3, the filters 4 are produced and then joined to the wrapped tobacco rods 2, which are produced in a conventional manner, by the tipping paper 6 using known filter cigarette making equipment.

To produce the multi-component filter 4 of the filter cigarette 20 shown in FIG. 2, separate continuous rods comprising multiple units of each segment 12, 14, 16 of the multi-component filter 4 are produced in a known manner and then combined to form a continuous filter rod comprising multiple units of the multi-component filter 4. The continuous filter rod is then severed at regular intervals by a cutting mechanism to yield a succession of discrete multi-component filters.

To produce the multi-component filter 4 of the filter cigarette 30 shown in FIG. 3, separate continuous rods comprising multiple units of each segment 12, 16 of the multi-component filter 4 are produced in a known manner. The segments 12, 16 are then placed in a plug wrap material in a manner that creates a space between the segments 12, 16. The space is filled with the granules and then the plug wrap material is wrapped around the segments 12, 16, enclosing the granules within the space.

The following comparative example demonstrates the improved flavour deliver of smoking articles according to the present invention:

COMPARATIVE EXAMPLE

Flavour granules were formed from peppermint leaf having an original average bulk density of around 0.28 grams per cubic centimetre. The peppermint leaf was cut to a particle size of 0.2 mm to 0.5 mm and the cut particles of peppermint leaf were sprayed with steam to form a paste having a moisture content of 35% to 45% oven volatiles. The paste was then extruded at high pressure through a screw extruder to increase the density of the plant material and form a plurality of flavour granules having a bulk density of around 0.54 grams per cubic centimetre. The flavour granules were then dried and cut to form cylindrical granules having a particle size of 0.2 mm to 1.5 mm.

Three sample filter cigarettes were produced incorporating a tobacco rod and a filter incorporating plant material within a cavity, between a mouth end segment and a rod end segment (see Table 1). In the first filter cigarette (Sample 1), dried cut peppermint leaf was incorporated into the cavity without compaction. In the other two filter cigarettes (Sample 2 and Sample 3), a plurality of the flavour granules was provided in the cavity. Each of the filter cigarettes was smoked under ISO conditions (35 ml puffs lasting 2 seconds each, every 60 seconds) and the mainstream smoke was collected and extracted into an organic solvent. The liquid extract was analysed by gas chromatography to determine the amount of menthol released from the plant material in each filter cigarette during smoking. The results of the tests are shown in Table 1 below.

It can be seen from Table 1 that the peppermint leaf in the flavour granules was compacted so that the bulk density of the flavour granules was about twice that of the original peppermint leaf. It was surprisingly been found that the delivery of menthol into the smoke from the flavour granules during smoking of the samples under ISO conditions (per unit volume of plant material) is greater than double than the delivery of menthol from the uncompacted peppermint leaf. In particular, it can be seen by comparing the measured values of menthol delivery for Sample 1 and Sample 2 that the menthol delivery per unit volume increases by over 150% when the peppermint leaf of Sample 1 is replaced with the same mass of peppermint leaf in the compacted flavour granules. The improvement in the menthol delivery is therefore significantly greater than that expected based on the increase in the bulk density of the peppermint leaf, which corresponds to around 93%.

TABLE 1

| | SAMPLE 1 | SAMPLE 2 | SAMPLE 3 |
|---|---|---|---|
| Form of peppermint leaf | cut peppermint leaf; uncompacted | flavour granules; compacted | flavour granules; compacted |
| Mass of peppermint leaf in filter | 75.0 g | 75.0 g | 195.0 g |
| Bulk density of peppermint leaf | 0.28 g/cm$^3$ | 0.54 g/cm$^3$ | 0.54 g/cm$^3$ |
| Length of cavity | 7 mm | 3 mm | 7 mm |
| Volume of cavity | 338 mm$^2$ | 145 mm$^2$ | 338 mm$^2$ |
| Amount of available menthol | 667 micrograms | 660 micrograms | 1706 micrograms |
| Total amount of menthol delivered into smoke | 9.5 micrograms | 11.3 micrograms | 27.2 micrograms |
| Menthol delivery per unit bulk volume of peppermint leaf | 0.032 micrograms/cm$^3$ | 0.081 micrograms/cm$^3$ | 0.076 micrograms/cm$^3$ |

The comparative example illustrates the significant improvement in flavour delivery provided by smoking articles of the present invention comprising a plurality of flavour granules formed of compacted herbaceous plant material.

The invention claimed is:

1. A smoking article comprising a plurality of flavour granules formed of a compacted herbaceous plant material capable of releasing flavour into the smoke produced by the smoking article, wherein original herbaceous plant material is compacted to increase bulk density and form the compacted herbaceous plant material such that bulk density of the flavour granules is at least 1.5 times bulk density of the original herbaceous plant material, the bulk density of the flavour granules being at least 0.35 grams per cubic centimetres and no more than 2 grams per cubic centimeter and wherein the flavour granules are free of non-water binder material.

2. A smoking article according to claim 1 comprising a filter having a flavour release segment including a plurality of the flavour granules.

3. A smoking article according to claim 2 wherein the flavour release segment includes a plug of fibrous filtration material in which the flavour granules are distributed and the fibrous filtration material comprises fibres that are substantially aligned in the longitudinal direction of the filter and that extend along substantially the entire length of the plug of fibrous filtration material.

4. A smoking article according to claim 2 wherein the flavour release segment includes a plug of fibrous filtration material in which the flavour granules are distributed and the plug of fibrous filtration material comprises randomly oriented fibres that extend part way along the length of the plug of fibrous filtration material.

5. A smoking article according to claim 2 wherein the flavour release segment includes a cavity at least partially filled with the flavour granules.

6. A smoking article according to claim 5 wherein the cavity contains on average at least 0.5 mg of the compacted herbaceous plant material per cubic millimeter of the cavity.

7. A smoking article according to claim 2 wherein the filter further comprises at least one of:

a mouth end segment downstream of the flavour release segment; and a rod end segment upstream of the flavour release segment.

8. A smoking article according to claim 1 comprising a rod of smokable material within which a plurality of the flavour granules is dispersed.

9. A smoking article according to claim 1 wherein the herbaceous plant material comprises herb leaf, comprising peppermint leaf.

10. A smoking article according to claim 1 wherein the plant material is compacted such that the bulk density of the compacted plant material is about twice that of the original plant material.

11. A smoking article according to claim 1 wherein the flavour granules are extruded granules.

12. A smoking article according to claim 1 wherein the flavour granules comprise compacted peppermint leaf and wherein the flavour granules release at least 0.05 micrograms of menthol per bulk cubic centimeter of plant material during smoking of the smoking article under ISO conditions.

13. A smoking article according to claim 12 wherein the flavour granules comprise compacted peppermint leaf and wherein the flavour granules release at least 0.06 micrograms of menthol per bulk cubic centimetre of plant material during smoking of the smoking article under ISO conditions.

14. A smoking article according to claim 5 wherein the filter further comprises at least one of:

a mouth end segment downstream of the flavour release segment; and a rod end segment upstream of the flavour release segment.

15. A smoking article according to claim 6 wherein the filter further comprises at least one of:

a mouth end segment downstream of the flavour release segment; and a rod end segment upstream of the flavour release segment.

16. Method of forming a smoking article comprising the steps of:

combining a plurality of flavour granules in a smoking article, wherein the flavour granules are formed of a compacted herbaceous plant material capable of releasing flavour into the smoke produced by the smoking article, wherein original herbaceous plant material is compacted to increase bulk density and form the compacted herbaceous plant material such that bulk density of the flavour granules is at least 1.5 times bulk density of the original herbaceous plant material, the bulk density of the flavour granules being at least 0.35 grams per cubic centimetres and no more than 2 grams per cubic centimeter and wherein the flavour granules are free of non-water binder material.

* * * * *